US007357661B2

(12) United States Patent
Yamamoto et al.

(10) Patent No.: US 7,357,661 B2
(45) Date of Patent: Apr. 15, 2008

(54) PRESSURE COUPLING CONNECTOR

(75) Inventors: Toshihiro Yamamoto, Kadoma (JP); Norimasa Kaji, Kadoma (JP); Hirohisa Tanaka, Kadoma (JP); Hidetoshi Takeyama, Kadoma (JP); Shuji Katou, Kadoma (JP); Mitsuhiro Kadowaki, Kadoma (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/579,109

(22) PCT Filed: Jan. 26, 2006

(86) PCT No.: PCT/IB2006/050276

§ 371 (c)(1),
(2), (4) Date: Oct. 31, 2006

(87) PCT Pub. No.: WO2006/090296

PCT Pub. Date: Aug. 31, 2006

(65) Prior Publication Data

US 2007/0232124 A1 Oct. 4, 2007

(30) Foreign Application Priority Data

Feb. 25, 2005 (JP) ..... 2005-051642

(51) Int. Cl.
*H01R 4/24* (2006.01)

(52) U.S. Cl. ..... 439/435

(58) Field of Classification Search ..... 439/425, 439/403–404, 417–419, 409–410, 395, 501, 439/449, 420, 709, 721, 422, 396–397, 399, 439/942

See application file for complete search history.

(56) References Cited

U.S. PATENT DOCUMENTS

| | | | | |
|---|---|---|---|---|
| 3,985,416 | A * | 10/1976 | Dola et al. | 439/403 |
| 6,080,006 | A * | 6/2000 | Broder | 439/409 |
| 2004/0029431 | A1 * | 2/2004 | Comini | 439/417 |

FOREIGN PATENT DOCUMENTS

JP 9-35771 A 2/1997

* cited by examiner

*Primary Examiner*—Edwin A. Leon
(74) *Attorney, Agent, or Firm*—Sughrue Mion, PLLC

(57) ABSTRACT

Provided is a pressure coupling connector which can decrease the number of components for coping with various electric wire diameters, prevent problems due to difference in product kind, and reduce the stock. The pressure coupling connector includes a wire holding block for holding electric wires and a contact block for holding a connection terminal to which the electric wire is coupled with pressure by inserting the wire holding block into the contact block. The connection terminal of the contact block includes a U-shaped blade rising toward an opening surface into which the wire holding block is inserted. The wire holding block includes a wire holding portion in which a holding hole for transmitting the electric wire from the rear side thereof and holding the electric wire is formed and a reception groove for receiving the U-shaped blade of the connection terminal. The U-shaped blade of the connection terminal includes a core pressing blade having a step-shaped slit with two different widths in the vertical direction and a wire holding blade having a step-shaped slit with two different widths in the vertical direction, sequentially from the inside in an electric wire insertion direction. Adapting to the outer shape of an electric wire, the electric wire can be held with a wire holding slit (upper step portion) 53*a* or a wire holding slit (lower step portion) 53*b*.

3 Claims, 11 Drawing Sheets

[Fig. 1]
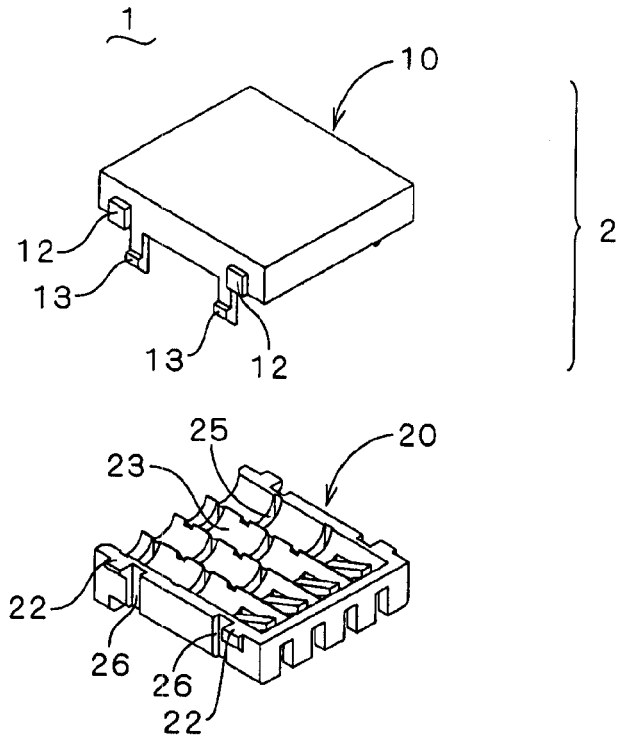
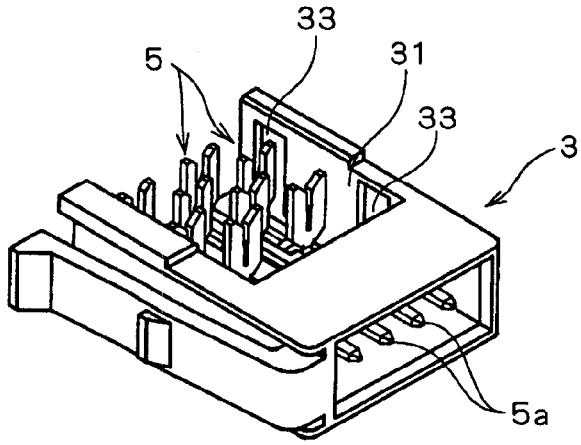
[Fig. 2]
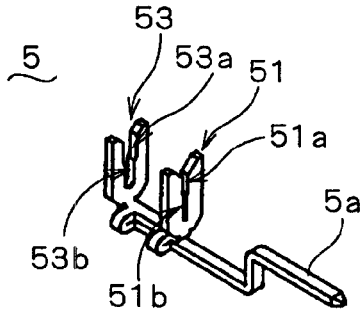

[Fig. 3]
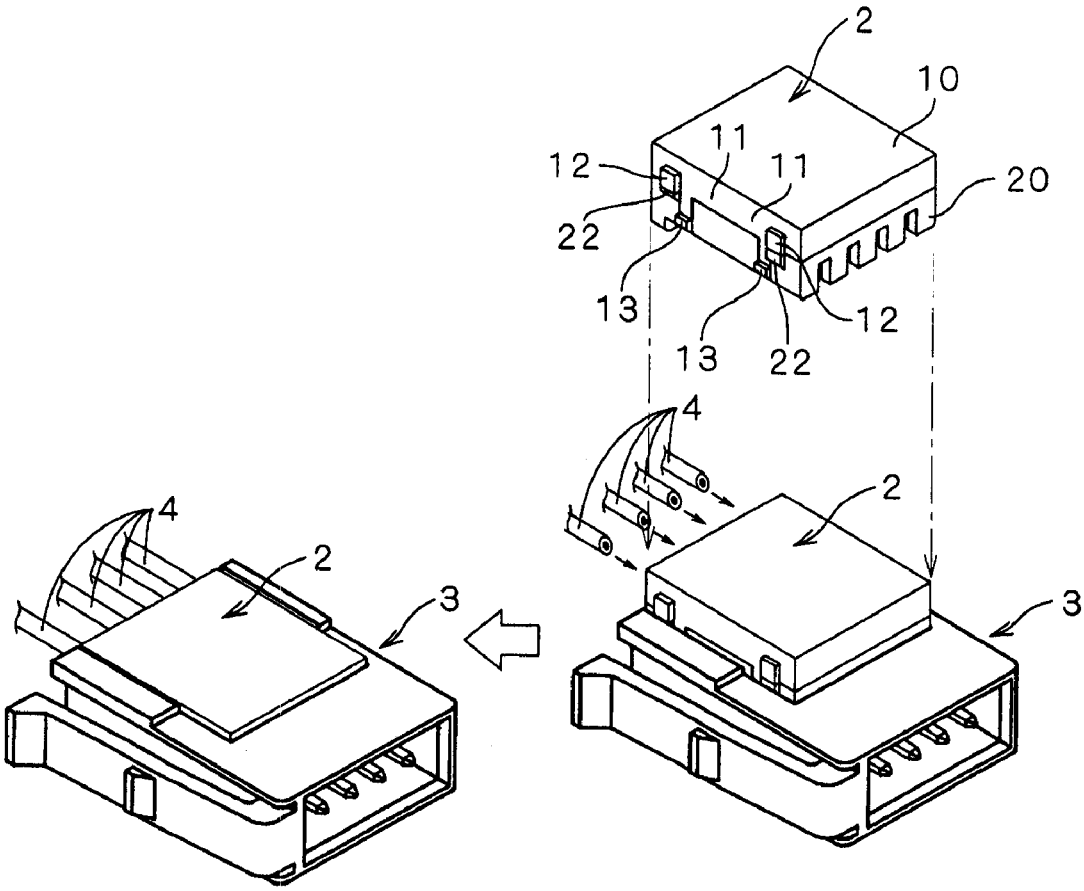

[Fig. 4]
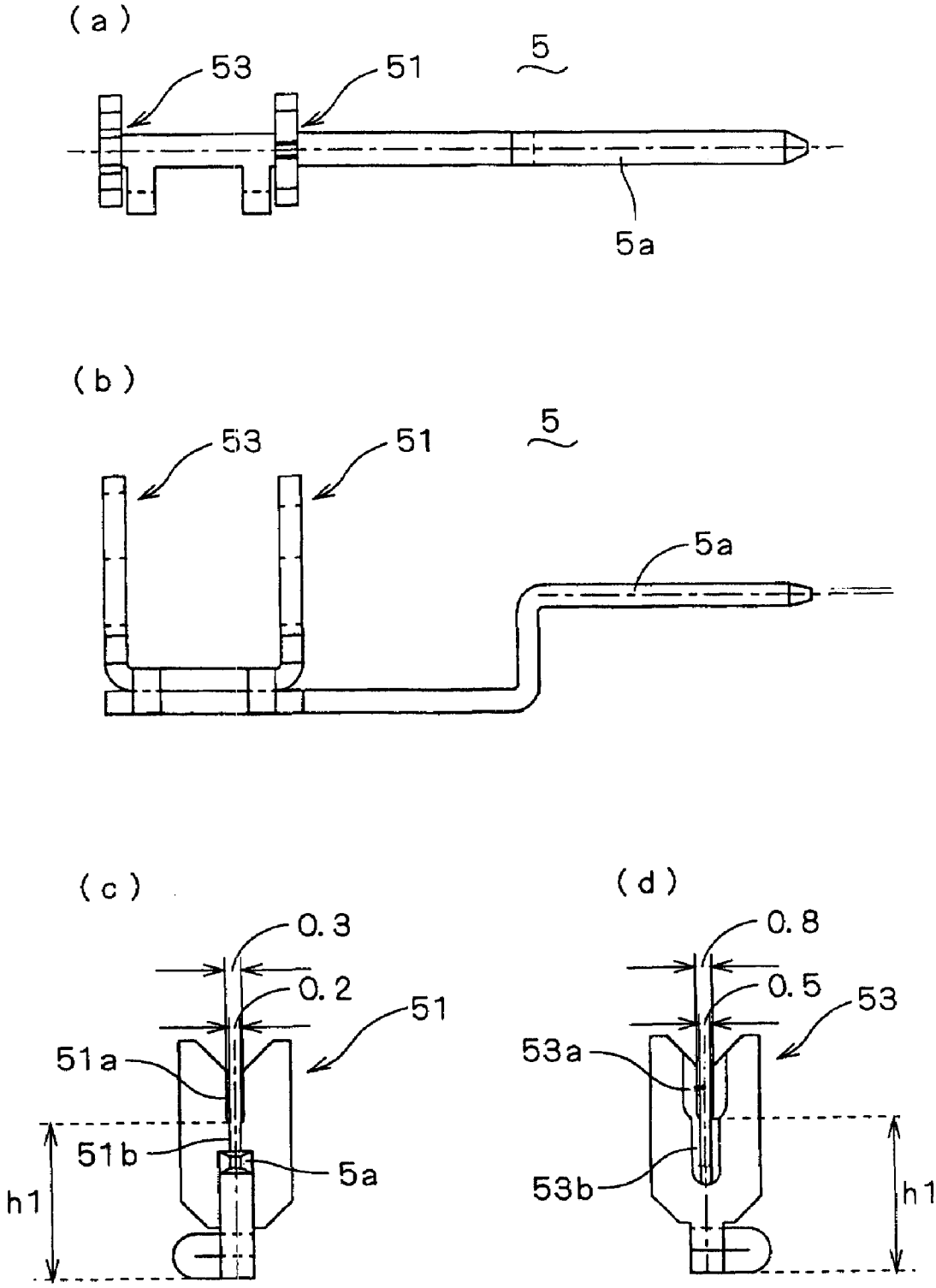

[Fig. 5]
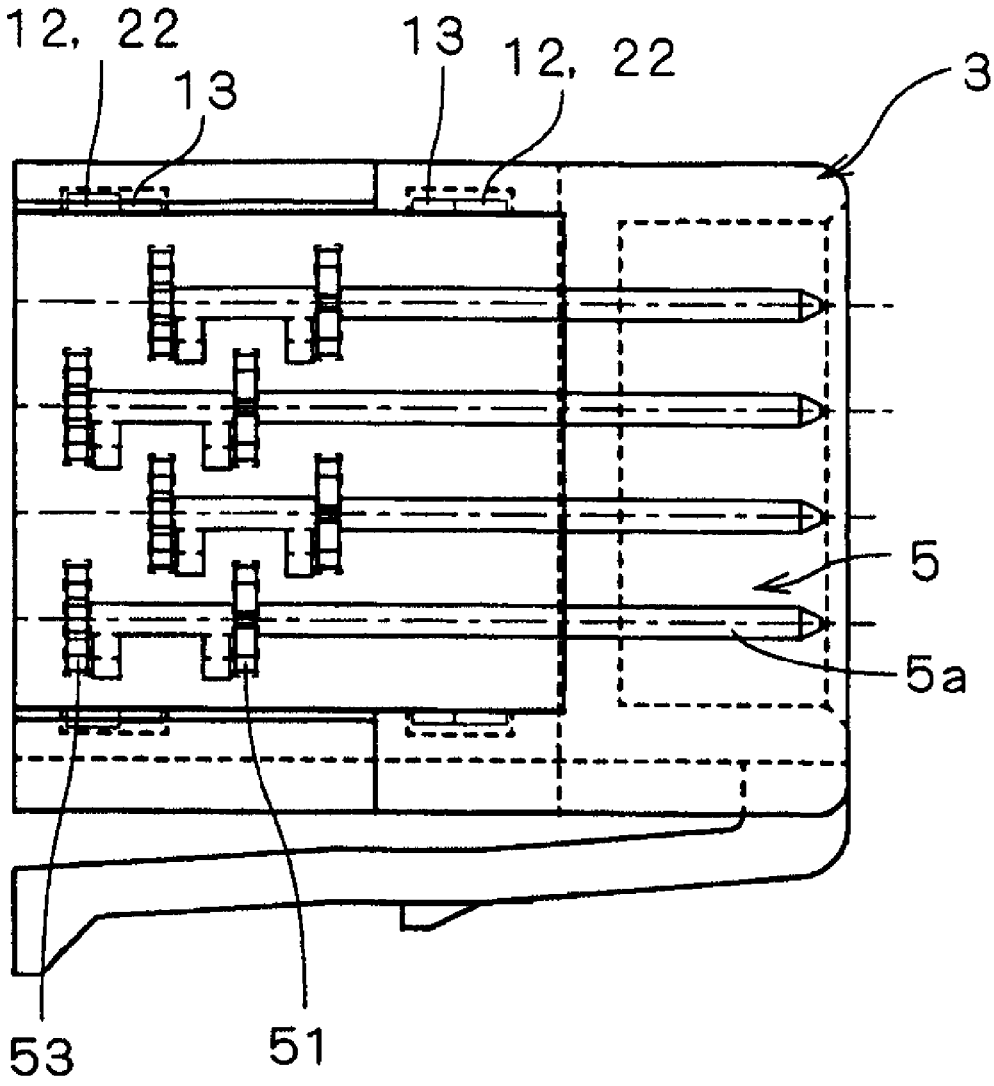

[Fig. 6]
(a)
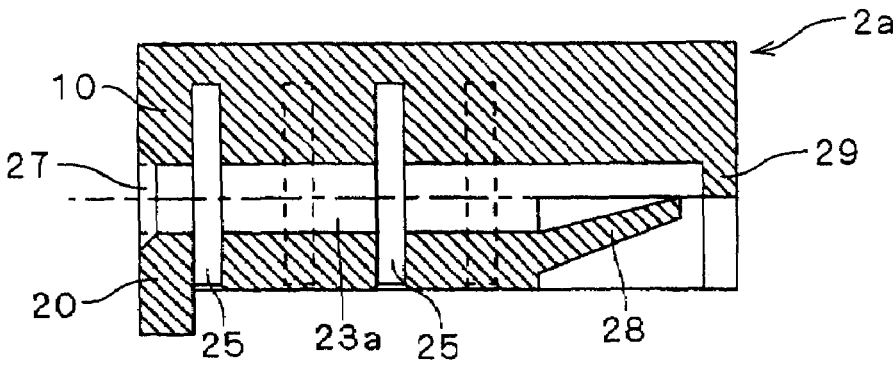
(b)
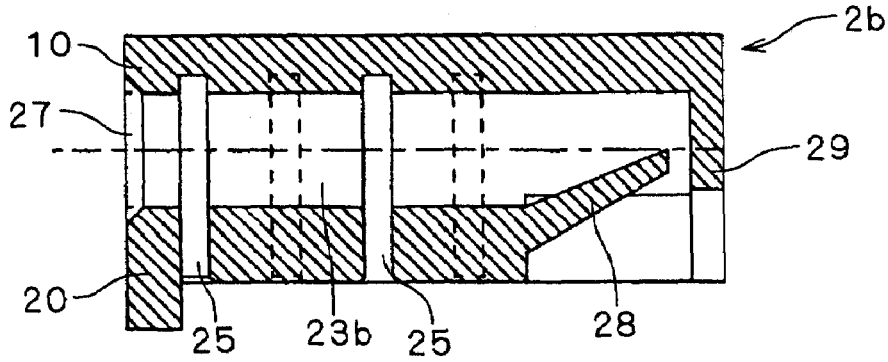
(c)
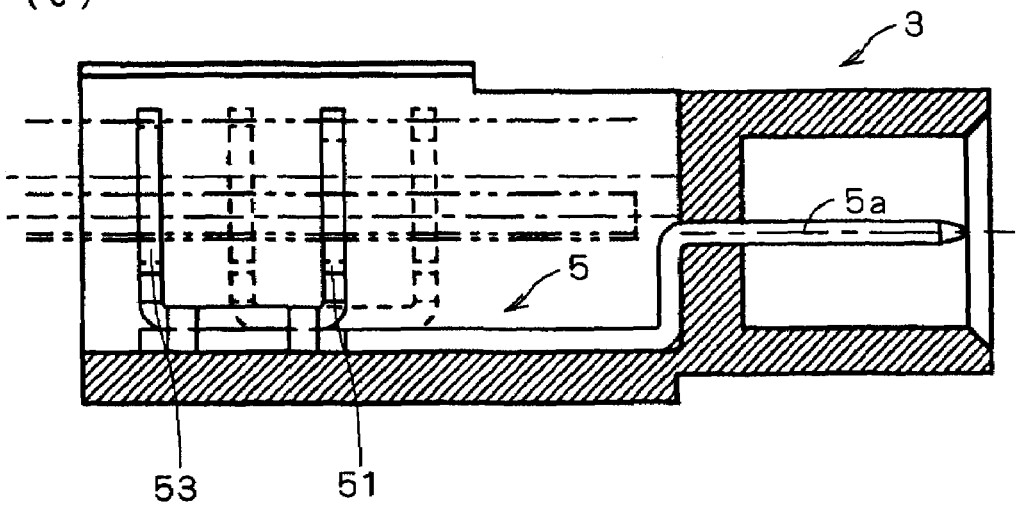

[Fig. 7]
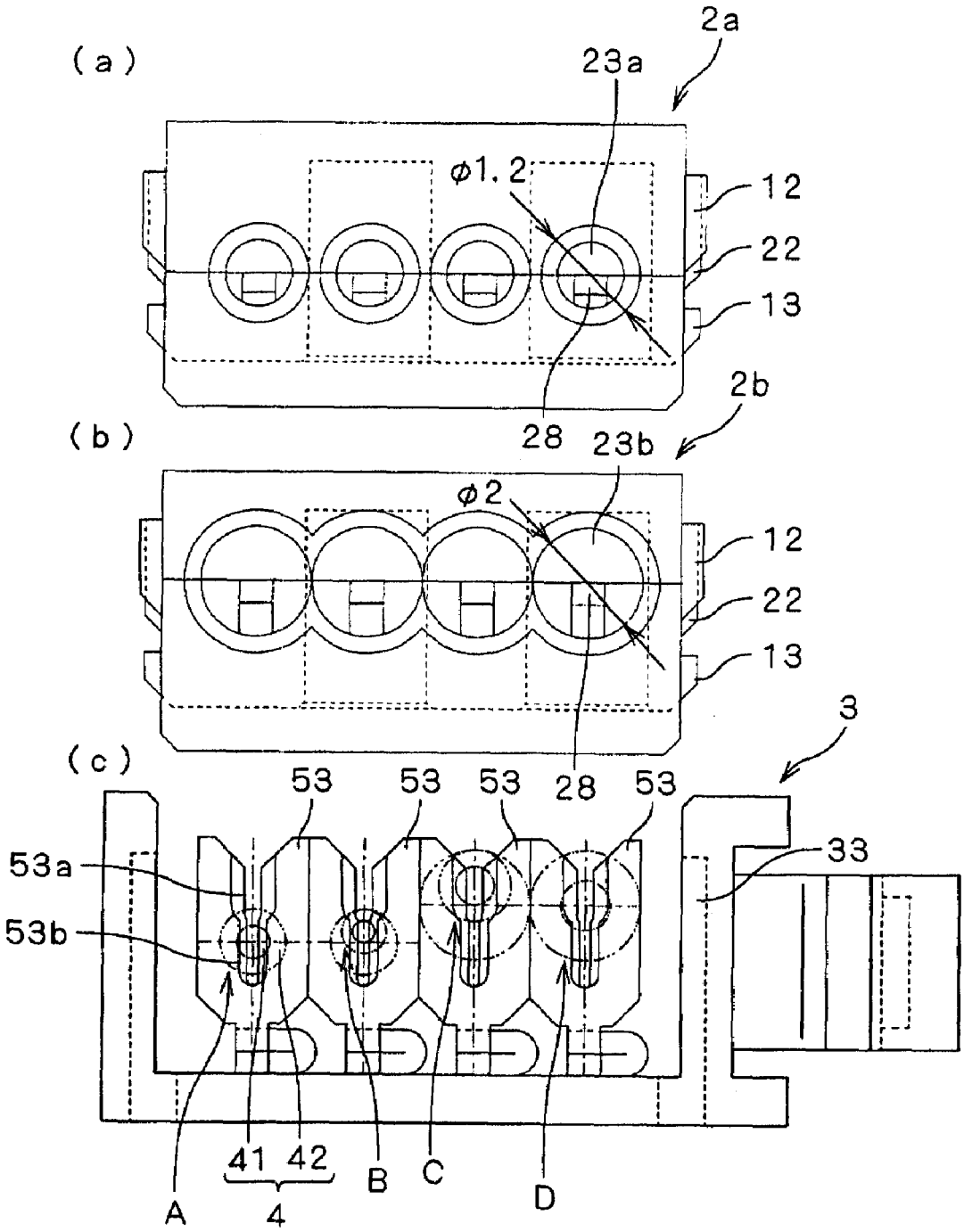

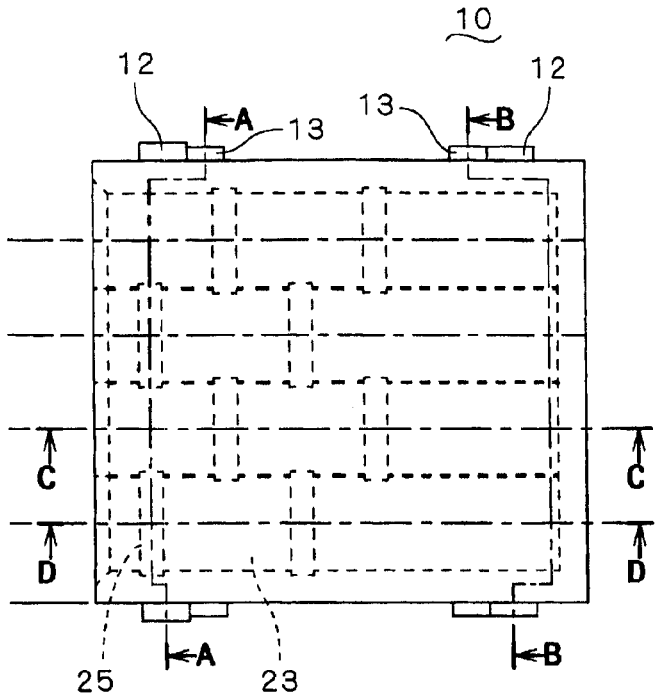
[Fig. 8]
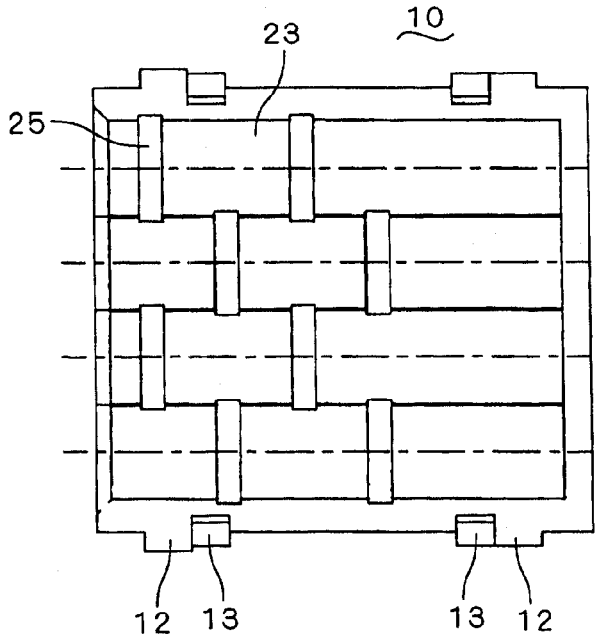
[Fig. 9]
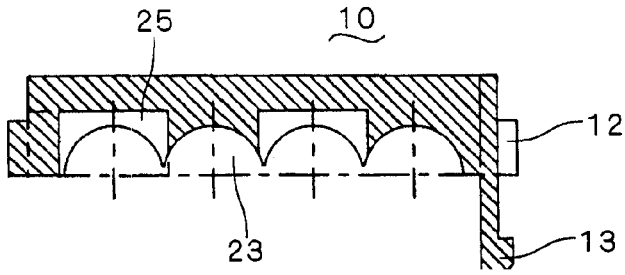
[Fig. 10]

[Fig. 11]
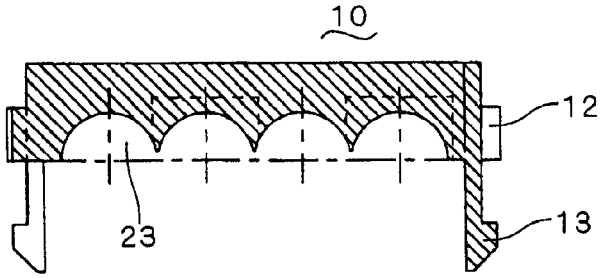
[Fig. 12]
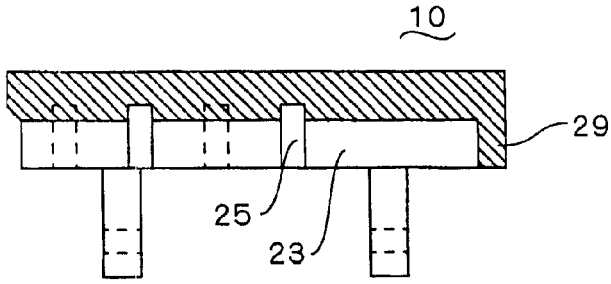
[Fig. 13]
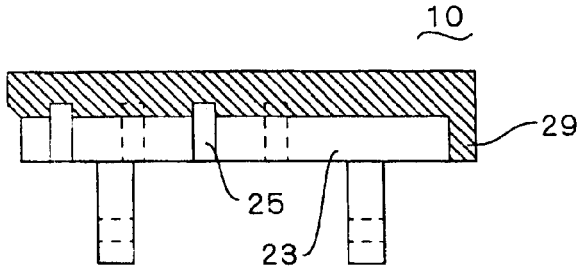
[Fig. 14]
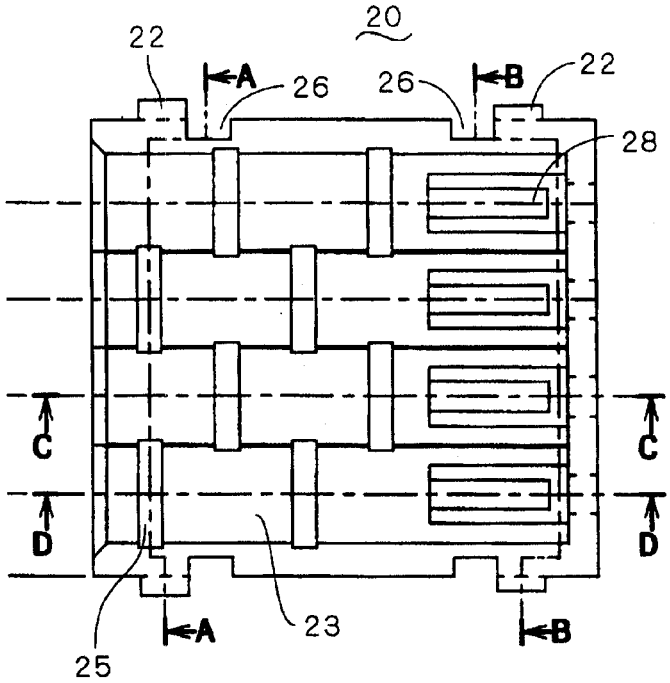

[Fig. 15]
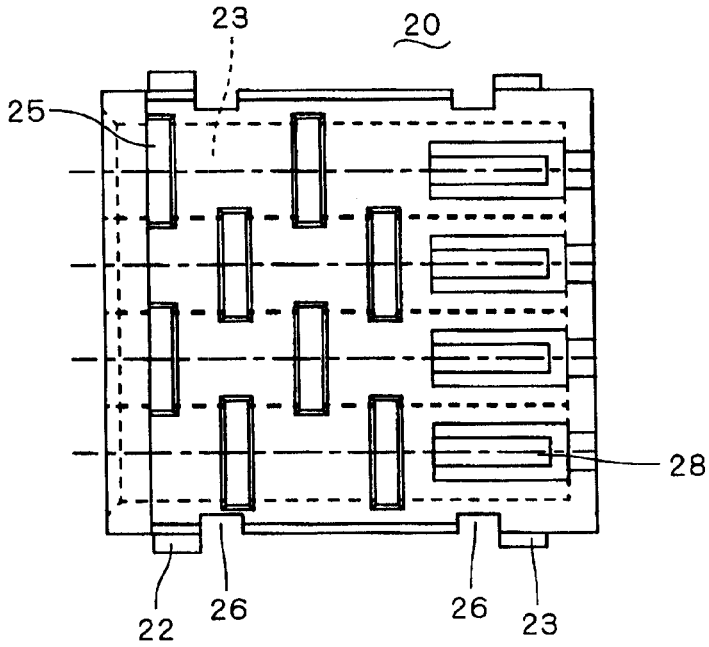
[Fig. 16]
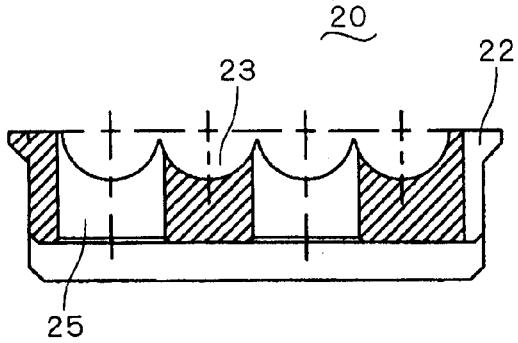
[Fig. 17]
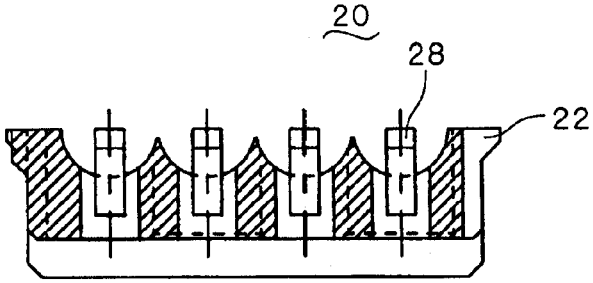
[Fig. 18]
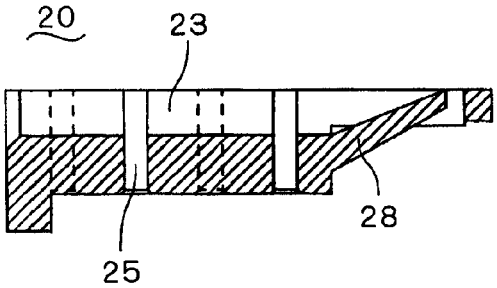

[Fig. 19]
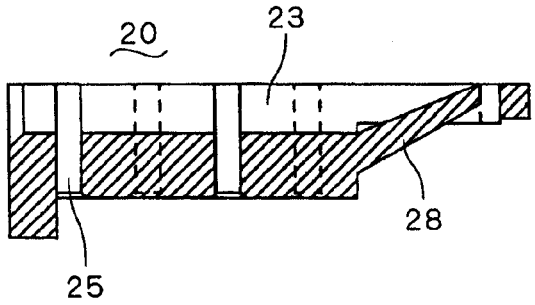
[Fig. 20]
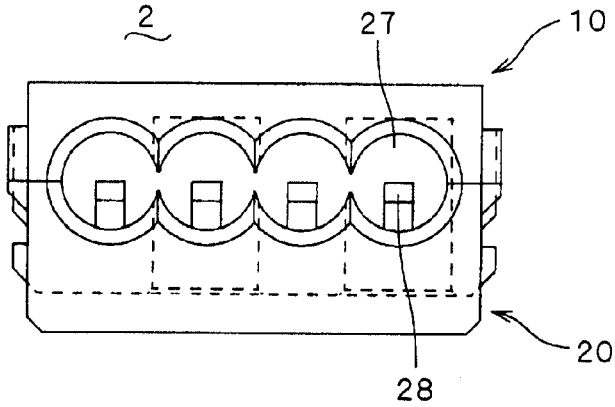
[Fig. 21]
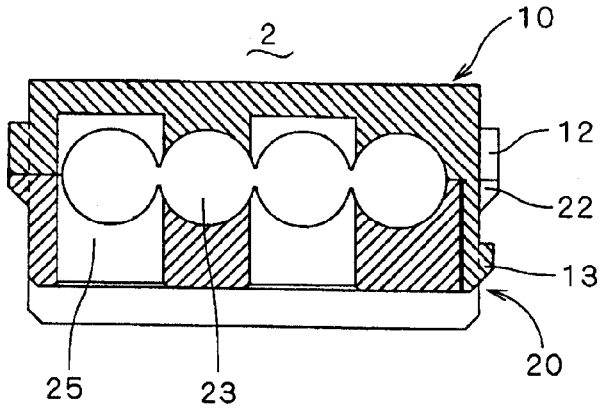
[Fig. 22]
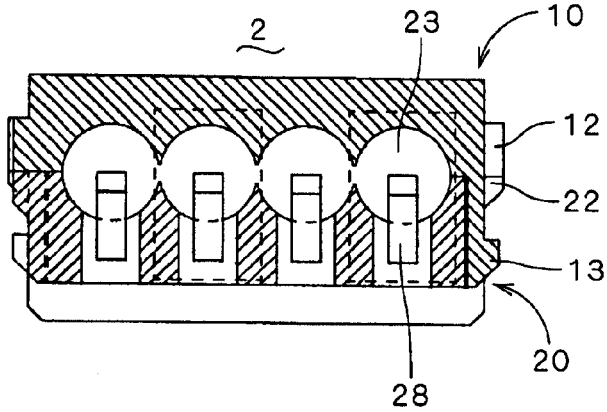

[Fig. 23]
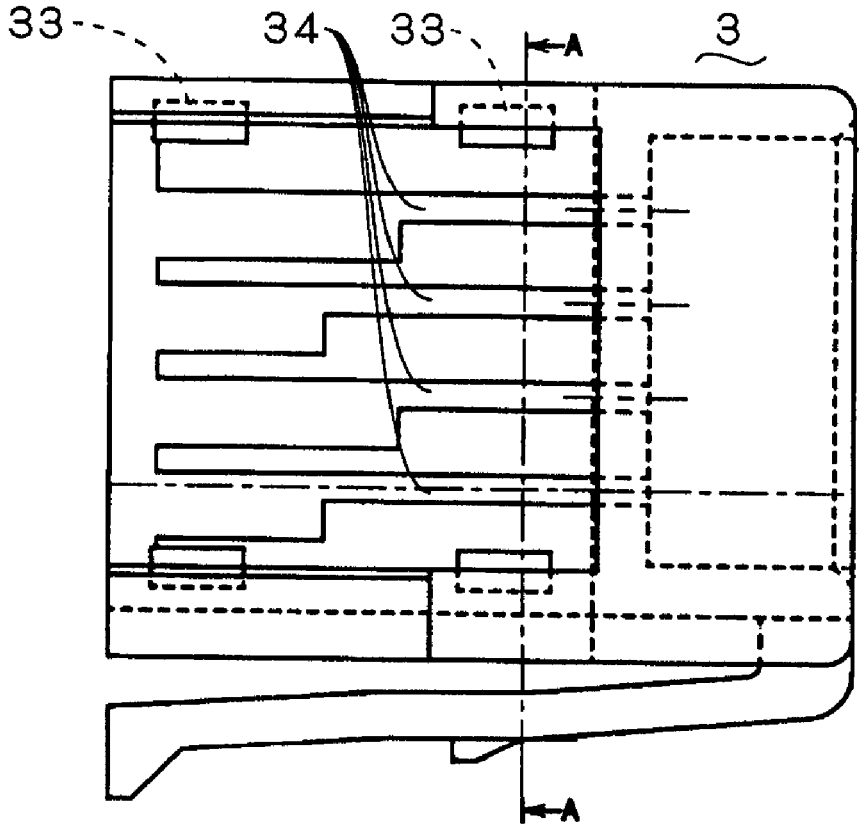
[Fig. 24]
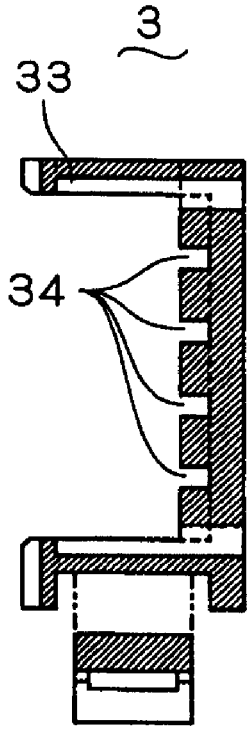

PRESSURE COUPLING CONNECTOR

TECHNICAL FIELD

The present invention relates to a pressure coupling connector for accomplishing electrical connection by coupling electric wires (lead wires or cables) to connection terminals with pressure.

BACKGROUND ART

Conventionally, as such a kind of connector, there was known a connector in which an insulating housing is formed by integrally coupling a pressure block (wire holding block) to a terminal block (contact block) at the ends thereof and pressure coupling is performed by inserting cables held by the pressure block into connection terminal grooves (for example, see JP-A-9-35771). Such a clamp type of pressure coupling connector provides excellent workability and enables satisfactory insertion works.

DISCLOSURE OF INVENTION

Technical Problem

However, in such a conventional pressure coupling connector, various kinds of wire holding blocks (different wire holding diameters) and terminal blocks are provided and various combinations thereof are used, in order to cope with various kinds of electric wires having different sectional area (for example, about AWG 20 to 26). Accordingly, the number of components increases to cope with various wire diameters, stock increases, and problems due to difference in product kind are often caused.

Technical Solution

The present invention is contrived in consideration of the above-mentioned problems. It is an object of the present invention to provide a pressure coupling connector which can decrease the number of components for coping with various wire diameters, prevent problems due to difference in product kind, and reduce the stock.

According to an aspect of the present invention, there is provided a pressure coupling connector comprising a wire holding block for holding a electric wire and a contact block for holding a connection terminal to which the electric wire is coupled with pressure by inserting the wire holding block into the contact block, wherein the connection terminal includes a U-shaped blade rising toward an opening surface of the contact block into which the wire holding block is inserted, wherein the wire holding block includes a wire holding portion in which a holding hole for transmitting the electric wire from the rear side thereof and holding the electric wire is formed and a reception groove for receiving the U-shaped blade of the connection terminal, and wherein the U-shaped blade of the connection terminal includes a core pressing blade having a step-shaped slit with two different widths in the vertical direction and a wire holding blade having a step-shaped slit with two different widths in the vertical direction, sequentially from the inside in a electric wire insertion direction.

Two kinds of wire holding blocks may be prepared, the holding holes of which correspond to vertical positions having the different widths in the slit of the U-shaped blade, respectively.

Advantageous Effects

Since the pressure coupling connector according to the present invention includes the core pressing U-shaped blades and the wire holding U-shaped blades having a step-shaped slit with two different widths in the vertical direction, the cores can be connected and the electric wires can be held appropriately regardless of the magnitudes in diameter of the electric wires, only by using one connector or a small number of connectors. Accordingly, it is possible to cope with the electric wires having various diameters only with a small number of product kinds, so that the number of components can be decreased, the problems due to difference in product kind can be reduced, and the stock can be reduced.

DESCRIPTION OF DRAWINGS

The above and other features and advantages of the present invention will become more apparent by describing in detail exemplary embodiments thereof with reference to the attached drawings in which:

FIG. 1 is an exploded perspective view illustrating a pressure coupling connector according to an embodiment of the present invention;

FIG. 2 is a perspective view illustrating a connection terminal in the pressure coupling connector;

FIG. 3 is a perspective view illustrating a state that a wire holding block is inserted into a contact block in the pressure coupling connector;

FIG. 4A is a plan view of the connection terminal, FIG. 4B is a side view of the connection terminal, FIG. 4C is a front side view of the connection terminal, and FIG. 4D is a back side view of the connection terminal;

FIG. 5 is a plan view of the pressure coupling connector;

FIG. 6A is a cross-sectional view illustrating an example of the wire holding block in the pressure coupling connector, FIG. 6B is a cross-sectional view illustrating another example of the wire holding block, and FIG. 6C is a cross-sectional view of the contact block;

FIG. 7A is a front side view illustrating an example of the wire holding block in the pressure coupling connector, FIG. 7B is a front side view illustrating another example of the wire holding block, and FIG. 7C is a back side view of the contact block;

FIG. 8 is a plan view illustrating an upper block in the pressure coupling connector;

FIG. 9 is a bottom view of the upper block;

FIG. 10 is a cross-sectional view taken along Line A-A of FIG. 8;

FIG. 11 is a cross-sectional view taken along Line B-B of FIG. 8;

FIG. 12 is a cross-sectional view taken along Line C-C of FIG. 8;

FIG. 13 is a cross-sectional view taken along Line D-D of FIG. 8;

FIG. 14 is a plan view illustrating a lower block in the pressure coupling connector;

FIG. 15 is a bottom view of the lower block;

FIG. 16 is a cross-sectional view taken along Line A-A of FIG. 14;

FIG. 17 is a cross-sectional view taken along Line B-B of FIG. 14;

FIG. 18 is a cross-sectional view taken along Line C-C of FIG. 14;

FIG. 19 is a cross-sectional view taken along Line D-D of FIG. 14;

FIG. 20 is a back side view illustrating a state that the upper and lower blocks are coupled to each other in the pressure coupling connector;

FIG. 21 is a diagram corresponding to the cross-sectional view taken along Line A-A of FIGS. 8 and 14;

FIG. 22 is a diagram corresponding to the cross-sectional view taken along Line B-B of FIGS. 8 and 14;

FIG. 23 is a plan view of the contact block; and

FIG. 24 is a cross-sectional view taken along Line A-A of FIG. 23.

BEST MODE

Hereinafter, a pressure coupling connector according to an embodiment of the present invention will be described in detail with reference to the attached drawings. As shown in FIGS. 1 to 3, the pressure coupling connector 1 according to the present embodiment includes a wire holding block 2 for holding plural strands of electric wires 4 (four strands in the present embodiment) and a contact block 3 to which the electric wires are connected with pressure by inserting the wire holding block 2 into the contact block 3. The respective blocks 2 and 3 are made of an insulating resin molded body. The wire holding block 2 includes an upper block 10 and a lower block 20 which are overlapped with each other to form a wire holding portion for holding the electric wires 4. The contact block 3 holds four connection terminals 5 in the present embodiment and serves as a plug which is inserted into an electric outlet not shown. Front ends 5*a* of the connection terminals 5 become contact pins for contacting a conductive portion of the electric outlet.

The connection terminals 5 include a U-shaped blade rising upwardly, as shown in FIG. 2, so as to cope with connections of electric wires having various diameters from a small diameter to a large diameter. The U-shaped blade includes a core pressing U-shaped blade 51 having a step-shaped slit with two different widths in the vertical (height) direction and a wire holding U-shaped blade 53 having a step-shaped slit with two different widths in the vertical (height) direction, sequentially from the front end 5*a* of the connection terminal 5, that is, sequentially from the inside in a electric wire insertion direction. That is, the core pressing U-shaped blade 51 has a core pressing slit (upper step portion) 51*a* and a core pressing slit (lower step portion) 51*b* and the wire holding U-shaped blade 53 has a wire holding slit (upper step portion) 53*a* and a wire holding slit (lower step portion) 53*b*. In the respective U-shaped blades, the upper end portion of each slit is widened in a V shape, thereby make it easy to receive and fix the electric wire 4 pressed downwardly.

In the contact block 3, the surface into which the wire holding block 2 is inserted is opened and the respective U-shaped blades of the connection terminals 5 rise toward the opening surface 31. A concave portion 33 for fixing the wire holding block 2 is formed on the inside surface of the opening surface 31 of the contact block 3.

A plurality of holding holes 23 constituting the wire holding portion into which the electric wires 4 are inserted from the rear side thereof and which holds the electric wires are formed in the upper and lower blocks 10 and 20 of the wire holding block 2. In addition, a plurality of reception grooves 25 for receiving the respective U-shaped blades 51 and 53 of the connection terminal 5 are formed therein.

A protrusion 12 and a temporarily fixing projected piece 13 are formed on the side surface of the upper block 10 and a groove 26 extending vertically and a protrusion 22 are formed on the side surface of the lower block 20. The bottom surface of the temporarily fixing projected piece 13 and the bottom surface of the protrusion 22 are tapered to make the engagement easy.

When the upper and lower blocks 10 and 20 are overlapped with each other to be in a body, the temporarily fixing projected piece 13 slides into and engages with the groove 26, as shown in the right upper side of FIG. 3. The overlapped wire holding block 2 is inserted into the opening portion 31 of the contact block 3. When the temporarily fixing projected piece 13 is hooked to the concave portion 33, as shown in the right lower side of FIG. 3, the wire holding block 2 is semi-coupled to the contact block 3 in a temporary fixing state. The pressure coupling connector 1 is delivered in the temporary fixing state for actual use.

In the actual use, as shown in FIG. 3, the coated electric wires 4 are inserted into the wire holding block 2 in the temporary fixing state and are held therein, and then the wire holding block 2 is further pushed into the contact block 3. The pushing work is performed by the use of a tool such as a punch. By coupling the protrusions 12 and 22 of the wire holding block 2 contacting vertically each other to be in a body to the concave portion 33 of the contact block 3, the prevention of release is accomplished. At the time of the coupling operation, details of which are described later, the coatings of the electric wires 4 are destroyed by the core pressing U-shaped blade 51 and thus the cores of the electric wires 4 are electrically connected to the connection terminals 5, respectively.

FIG. 4 shows a detailed structure of the connection terminal 5. In the core pressing U-shaped blade 51, the core pressing slit (upper step portion) 51*a* has a slit width of about 0.3 mm and the core pressing slit (lower step portion) 51*b* has a slit width of about 0.2 mm so that the slit width of the lower step portion is smaller than that of the upper step portion. In the wire holding U-shaped blade 53, the wire holding slit (upper step portion) 53*a* has a slit width of about 0.8 mm and the wire holding slit (lower step portion) 53*b* has a slit width of about 0.5 mm so that the slit width of the lower step portion is smaller than that of the upper step portion. The height of the core pressing U-shaped blade 51 is equal to the wire holding U-shaped blade 53 and the height hi of the steps of the respective slits is equal to each other.

Next, configurations of the contact block 3 and the wire holding block 2 will be described with reference to FIGS. 5 to 7. FIG. 5 is a perspective plan view illustrating the core pressing U-shaped blade 51 and the wire holding U-shaped blade 53 in the state where the wire holding block 2 is semi-coupled to the contact block 3. FIGS. 6A and 6B show two kinds of wire holding blocks 2*a* and 2*b*, respectively, and FIG. 6C shows the contact block 3. FIGS. 7A and 7B show two kinds of wire holding blocks 2*a* (for the lower step of the slit) and 2*b* (for the upper step of the slit), respectively, and FIG. 7C shows positions for holding electric wires having various diameters in the contact block 3. Here, in the wire holding block 2*a*, the wire holding hole 23*a* corresponds to the vertical position of the core pressing slit (lower step portion) 53*a* and in the other wire holding block 2*b*, the wire holding hole 23*b* corresponds to the vertical position of the core pressing slit (upper step portion) 51*a*. They also correspond to the vertical positions of the wire holding slit (lower step portion) 53*b* and the wire holding slit (upper step portion) 53*a*, respectively. The respective structures of the blocks become apparent with reference to FIGS. 8 to 24.

In FIGS. 5 to 7, the wire holding holes 23*a* and 23*b* of the wire holding blocks 2*a* and 2*b* are formed in the electric wire insertion direction from wire insertion holes 27 at the rear side by matching gutter-shaped concave portions having a semi-circular section formed in the upper and lower blocks 10 and 20 with each other. The wire holding hole 23*a* is used for a small-diameter electric wire, has a diameter of, for example, about 1.2 mm, a small inner diameter, and a central axis located at a lower position. The wire holding hole 23*b* is used for a large-diameter electric wire, has a diameter of, for example, about 2 mm, a small inner diameter, and a central axis located at an upper position. A push-up piece 28 for pushing up the front end of the inserted electric wire is formed at the front side in the electric wire insertion direction of the wire holding hole of the lower block 20 and a contact portion 29 contacting the end of the electric wire is formed at the front side in the electric wire insertion direction of the upper block 10. The neighboring connection terminals 5 are disposed in the contact block 3 such that the positions of the core pressing U-shaped blades 51 and the wire holding U-shaped blades 53 are deviated from each other. Accordingly, the lateral width of the contact block 3 can be reduced.

At the time of actual use, the electric wire 4 (comprising twisted cores and a covering) is inserted into the wire holding hole 23*a* or 23*b* of the wire holding block 2*a* or 2*b* temporarily fixed from the wire insertion hole 27. The electric wire 4 goes into the wire holding hole 23*a* or 23*b* and goes ahead while pushing up the push-up piece 28 in the wire holding hole, and when the end of the electric wire contacts the contact portion 29, the insertion of the electric wire is stopped.

In this way, after the electric wire 4 is inserted into and held in the wire holding hole, the wire holding block 2*a* or 2*b* is further inserted into the contact block 3. At the time of this insertion, the core pressing U-shaped blade 51 and the wire holding U-shaped blade 53 of the connection terminal 5 are inserted into the reception grooves 25 of the wire holding block 2*a* or 2*b* and the electric wire 4 is pressed by the top wall of the wire holding hole 23*a* or 23*b* of the wire holding block 2*a* or 2*b*, so that the covering is cut out with the U-shaped blades. Accordingly, the core of the electric wire 4 is coupled to the slit of the core pressing U-shaped blade 51 and the electric wire 4 is electrically connected to the connection terminal 5. In addition, the wire holding U-shaped blade 53 sticks in the covering of the electric wire 4, thereby preventing the release of the electric wire 4.

In FIG. 7C, holding positions of the electric wires with respect to the wire holding U-shaped blade 53 of the connection terminal 5 are shown when the wire holding block is further pushed into the contact block after the electric wires having various sizes are held in the wire holding block 2*a* or 2*b* temporarily fixed. In the figure, A, B, C, and D indicate holding (connecting) positions of the electric wires having F 1.2 mm, F 0.8 mm, F 1.3 mm, and F 2 mm, respectively. The outer circles correspond to the outer shapes of the electric wires and the inner circles correspond to the cores. Here, A and B indicate the states where the electric wire is pushed in the lower step of the slit by using the wire holding block 2*a*, and C and D indicate the states where the electric wire is pushed in the upper step of the slit by using the wire holding block 2*b*. At A and B, the cores are connected to the wire holding slits (lower steps) 53*b* and, at C and D, the cores are connected to the wire holding slits (upper steps) 53*a*. This is true of the core pressing slit (upper step) 51*a* and the core pressing slit (lower step) 51*b* of the core pressing U-shaped blade 51, the height of which is equal to that of the wire holding U-shaped blade 53.

In this way, by using different wire holding blocks 2*a* and 2*b* adapting to the outer shapes of the electric wires, the connection terminal 5 includes the core pressing U-shaped blade 51 and the wire holding U-shaped blade 53 having two slit widths in the vertical direction. Accordingly, the electric wires having various diameters from a small diameter to a large diameter can be connected and held with appropriate blades.

Next, referring to FIGS. 8 to 24, the detailed configurations of the upper block 10 and the lower block 20 of the wire holding block (2*b* indicated in FIG. 7) will be described.

FIGS. 8 to 13 show the upper block 10. The upper block 10 has a gutter-shaped wall constituting the upper halves of the wire holding holes 23 disposed in parallel and a plurality of reception grooves 25 for receiving the core pressing U-shaped blades 51 and the wire holding U-shaped blades 53 of the connection terminals 5 (reference numerals are attached to parts thereof in the figures). The other configurations are as described above.

FIGS. 14 to 19 show the lower block 20. The lower block 20 has a gutter-shaped wall constituting the lower halves of the wire holding holes 23 disposed in parallel and a plurality of reception grooves 25 for receiving the core pressing U-shaped blades 51 and the wire holding U-shaped blades 53 of the connection terminals 5. The reception grooves 25 are formed vertically. The other configurations are as described above.

FIGS. 20 to 22 show a state where the upper block 10 and the lower block 20 are coupled to each other to be in a body. FIG. 21 corresponds to the cross-section taken along Line A-A of FIGS. 8 and 14 and FIG. 22 corresponds to the cross-section taken along Line B-B of FIGS. 8 and 14.

FIGS. 23 and 24 show the configuration of the contact block 3. The contact block 3 has a plurality of grooves 34 for holding and fixing the plurality of connection terminals 5. The other configurations are as described above.

INDUSTRIAL APPLICABILITY

In the pressure coupling connector 1 according to the present embodiment described above, only by further inserting the wire holding block 2 in the temporarily fixed state into the contact block 3, the core pressing U-shaped blades 51 and the wire holding U-shaped blades 53 of the connection terminals 5 are inserted into the reception holes 25 of the wire holding block 2 to destroy the covering of the electric wires 4, thereby connecting the cores to the connection terminals 5. Here, since the core pressing U-shaped blades and the wire holding U-shaped blades having a step-shaped slit with two different widths in the vertical direction are provided, it is possible to cope with the electric wires having various outer diameters with the small number of components. It is possible to prevent problems due to difference in product kind and to reduce the stock.

The invention claimed is:

1. A pressure coupling connector comprising a wire holding block for holding a electric wire and a contact block for holding a connection terminal to which the electric wire is coupled with pressure by inserting the wire holding block into the contact block, wherein the connection terminal includes a U-shaped blade rising toward an opening surface of the contact block into which the wire holding block is inserted, wherein the wire holding block includes a wire holding portion in which a holding hole for transmitting the electric wire from the rear side thereof and holding the electric wire is formed and a reception groove for receiving the U-shaped blade of the connection terminal, and wherein the U-shaped blade of the connection terminal includes a core pressing blade having a step-shaped slit with two different widths in the vertical direction and a wire holding blade having a step-shaped slit with two different widths in the vertical direction, sequentially from the inside in an electric wire insertion direction.

2. The pressure coupling connector according to claim 1, wherein the wire holding block comprises separable upper and lower portions, the holding holes of which correspond to vertical positions having the different widths in the slit of the U-shaped blade or blades, respectively.

3. The pressure coupling connector of claim 1, arranged to receive a plurality of electrical wires, which need not have similar diameters, wherein the contact block has a plurality of connection terminals, wherein each connection terminal in the pressure coupling connector is kept electrically separate from all of the others, and wherein each connection terminal has a similar size at the exit of the contact block.

* * * * *